US009084454B2

(12) United States Patent
Ogura

(10) Patent No.: US 9,084,454 B2
(45) Date of Patent: Jul. 21, 2015

(54) SLIDE FASTENER

(75) Inventor: Suguru Ogura, Toyama (JP)

(73) Assignee: YKK Corporation (JP)

( * ) Notice: Subject to any disclaimer, the term of this patent is extended or adjusted under 35 U.S.C. 154(b) by 1141 days.

(21) Appl. No.: 13/060,020

(22) PCT Filed: Oct. 6, 2008

(86) PCT No.: PCT/JP2008/068190
§ 371 (c)(1),
(2), (4) Date: May 5, 2011

(87) PCT Pub. No.: WO2010/041303
PCT Pub. Date: Apr. 15, 2010

(65) Prior Publication Data

US 2011/0232047 A1 Sep. 29, 2011

(51) Int. Cl.
*A44B 1/04* (2006.01)
*A44B 19/38* (2006.01)
*A44B 19/12* (2006.01)

(52) U.S. Cl.
CPC ..... *A44B 19/382* (2013.01); *A44B 19/12* (2013.01); *A44B 19/388* (2013.01); *Y10T 24/2509* (2015.01); *Y10T 24/2545* (2015.01)

(58) Field of Classification Search
CPC .... A44B 19/382; A44B 19/12; A44B 19/388; A44B 19/08
USPC ..... 24/415, 433
See application file for complete search history.

(56) References Cited

U.S. PATENT DOCUMENTS

| | | | | |
|---|---|---|---|---|
| 4,312,103 | A | 1/1982 | Akashi | |
| 6,195,852 | B1 | 3/2001 | Kusayama | |
| 7,690,089 | B2 * | 4/2010 | Keyaki et al. | 24/386 |
| 8,806,725 | B2 * | 8/2014 | Keyaki et al. | 24/433 |
| 2005/0193528 | A1 * | 9/2005 | Hamada | 24/433 |
| 2006/0282998 | A1 * | 12/2006 | Kusayama et al. | 24/434 |
| 2008/0092347 | A1 * | 4/2008 | Ogura | 24/433 |
| 2009/0094805 | A1 * | 4/2009 | Keyaki et al. | 24/433 |

FOREIGN PATENT DOCUMENTS

| | | | |
|---|---|---|---|
| AU | 5921680 | A | 1/1981 |
| BR | 8003719 | A | 1/1981 |

(Continued)

OTHER PUBLICATIONS

International Search Report, PCT Application No. PCT/JP08/068190, mailed Jan. 13, 2009.

*Primary Examiner* — Robert J Sandy
*Assistant Examiner* — Matthew Sullivan
(74) *Attorney, Agent, or Firm* — Kilpatrick Townsend & Stockton LLP

(57) ABSTRACT

In slide fasteners, the difference between the interval A between the flange portions of sliders and the maximum value B of the separable pins in the tape width direction (interval A−maximum value B) satisfies the relation "(dimension C of the box pin corresponding to the maximum value B)<(interval A−maximum value B)<(element width D)", the maximum value B is smaller than the element width D, a dimension E of the separable pin in a tape length direction where the dimension is larger than the difference between the interval A and the element width D (interval A−element width D) and satisfies a relationship of "(dimension E)>(length of one pitch of the fastener elements)×3−(dimension of a coupling head of the tape length direction)×3".

5 Claims, 12 Drawing Sheets

(56) References Cited

FOREIGN PATENT DOCUMENTS

| | | | |
|---|---|---|---|
| CA | 1145920 | A | 5/1983 |
| CN | 1249153 | A | 4/2000 |
| DE | 69925347 | T2 | 2/2006 |
| EP | 21192 | A1 | 1/1981 |
| EP | 992201 | A1 | 4/2000 |
| ES | 251460 | U | 10/1980 |
| ES | 2239431 | T3 | 9/2005 |
| HK | 7188 | A | 2/1988 |
| HK | 1025887 | A | 11/2004 |
| JP | 59-32329 | Y1 | 9/1984 |
| JP | 6-30010 | Y2 | 8/1994 |
| JP | 2000106917 | A | 4/2000 |
| KR | 10-2000-0023476 | A | 4/2000 |
| TW | 463589 | Y | 11/2001 |
| TW | 526718 | | 4/2003 |

* cited by examiner

SLIDE FASTENER

This application is a national stage application of PCT/JP2008/068190, which is incorporated herein by reference.

TECHNICAL FIELD

The invention relates to a slide fastener where a separable pin and a box pin are disposed in a lower end of element rows constructed with continuous-shaped fastener elements, and more particularly, to a slide fastener capable of preventing left and right element rows from being erroneously coupled with each other when the slider is slid in the state where the separable pin is insufficiently inserted.

BACKGROUND ART

As a slide fastener for opening and closing left and right front parts of clothes, a slide fastener attached with a separable bottom end stop having a separable pin, a box pin, and a box in the lower ends of left and right element rows has been widely used.

In the slide fastener attached with a separable bottom end stop, in general, the separable pin is continuously disposed to the lower end of the one-side element row, and the box pin is continuously disposed to the lower end of the other-side element row. In addition, the slide fastener is configured so that the box for inserting the separable pin is fixedly disposed to the lower end portion of the box pin and so that the separable pin can be inserted into/detached from the box through a slider in the state where the slider is slid down to the lower end position contacting with the box.

Accordingly, in the slide fastener attached with a separable bottom end stop, after the separable pin is inserted into the box, the left and right element rows are coupled with each other by sliding the slider in the upward direction, that is, the element coupling direction. In addition, the left and right element rows that are coupled with each other are separated by sliding the slider toward the box in the downward direction, and after the slider contacts with the box, left and right fastener stringers are separated by detaching the separable pin from the box.

In addition, as a slide fastener for coupling and separating the left and right fastener stringers, a slide fastener where a reverse-opening lower slider is allowed to pass through the element rows instead of the aforementioned box is also well known. In the slide fastener, in general, two sliders, that is, the upper slider and the reverse-opening lower slider are allowed to pass through the element rows in the bottom-aligned state so as to allow the corresponding rear openings to face. In addition, the slide fastener is configured so that the separable pin can be inserted into/detached from the lower slider through the upper slider in the state where the upper and lower sliders are slid down to the lower end position where the box pin is disposed.

In addition, for example, Japanese Patent Application Laid-Open No. 2000-106917 (Patent Document 1) discloses a slide fastener which can be used as the upper-opening type or the two-side-opening type by selecting one of the box of the separable bottom end stop and the reverse-opening lower slider.

As illustrated in the case of using a box 78 in FIG. 15, a slide fastener 71 disclosed in Patent Document 1 includes fastener stringers 74 where coil-like fastener elements 73 are attached to facing side edge portions of a pair of left and right fastener tapes 72, a slider (not shown) which is allowed to pass through left and right element rows 75 constructed with the fastener elements 73, a separable pin 76 which is attached to an end portion of the one-side element row 75, a box pin 77 which is attached to an end portion of the other-side element row 75, and a box 78 which is fitted into the box pin 77.

The fastener stringer 74 includes a reinforcing portion 79 constructed with a thermoplastic resin film for reinforcing the end portion of the fastener tape 72. The end edge portion of the reinforcing portion 79 facing the tape is cut by a suitable size, and the thermoplastic-resin separable pin 76 or box pin 77 is disposed to the cut portion.

In addition, in the separable pin 76 and the box pin 77, thin guide portions 80 where the flanges of the slider can be freely slid are disposed to be adjacent to the separable pin 76 or the box pin 77. Rectangular parallelepiped-shaped reinforcing line portions 81 raised on the front and rear portions of the fastener tapes 72 are disposed to the sides of the guide portions 80. In addition, a stopper 82 whose height is smaller than that of the box pin 77 and larger than those of the reinforcing line portions 81 is formed from the front end of the box pin 77 to the front end of the reinforcing line portion 81 in a curved shape at the surface side of the guide portion 80. The guide portion 80, the reinforcing line portion 81, and the stopper 82 are formed to be integrated with the separable pin 76 or the box pin 77 by using a thermoplastic resin.

Furthermore, the separable pin 76 is formed so that the front end portion (the end portion opposite to the side of the element row 75) is slightly curved toward the inner side of the tape and so that the side wall of the reinforcing line portion 81 facing the separable pin 76 is cut out to be easily fitted into the box 78 or the reverse-opening slider. In addition, in the end portion of the separable pin 76 on the side of the element row 75, a protrusion 83 protrudes toward the box pin 77. When the left and right element rows 75 are coupled with each other, the protrusion 83 is coupled with the element 73 on the side of the box pin 77, so that the coupling strength in the end portion of the element row 75 is increased. On the other hand, a plurality of small protrusions 84 is erected on the side of the front end portion of the front surface (upper surface) of the box pin 77. By using the small protrusions 84, the later-described box 78 is fused and adhered to the box pin 77.

In the slide fastener 71 disclosed in Patent Document 1, in the case where the box 78 is fitted into the box pin 77, the outer appearance of the box 78 is formed in an approximately rectangular shape, and an insert groove (not shown) whose thickness is slightly smaller than that of the stopper 82 and which the portion where the guide portion 80 is formed can be inserted into is disposed in the box 78. In addition, the box 78 has a partitioning portion 85 in the central portion, and a box-pin-insertion hole 86 and a separable-pin-insertion hole 87 are disposed at the left and right portions thereof. In addition, an engaging hole (not shown) into which the stopper 82 is inserted to be engaged is disposed in the deepest portion of the box-pin-insertion hole 86.

The box 78 is inserted into the box pin 77, and the engaging hole provided in the deepest portion of the box-pin-insertion hole 86 is inserted into the stopper 82, so that the box 78 is fixed. After that, the small protrusions 84 formed to protrude on the box pin 77 is welded to the box 78 by performing an ultrasonic wave process from the surface side of the box 78, so that the separable bottom end stop of the slide fastener 71 is configured.

On the other hand, in Patent Document 1, in the case where the two-side-opening type slide fastener 71 is configured, the upper-opening upper slider and the reverse-opening lower slider may be allowed to pass through the fastener stringer 74 where the box pin 77 is formed. In this case, the same type slider can be used for the upper-opening slider and the reverse-opening slider.

In the case of the slide fastener 71 disclosed in Patent Document 1, the upper-opening type slide fastener 71 having one slider and the separable bottom end stop and the two-side-opening type slide fastener having a pair of sliders can be selectively manufactured at high efficiency without using a particular type slider, so that it is possible to stabilize and supply the slide fasteners in immediate response to the demands.

On the other hand, Taiwanese Patent No. 526718 (Patent Document 2) discloses a two-side-opening type slide fastener where a separable pin and a box pin which are injection-molded in a fastener stringer can be easily inserted into a slider and the slider is prevented from being detached from the separable pin and the box pin.

In the slide fastener disclosed in Patent Document 2, top stoppers are disposed in the one end of each of left and right element rows, and a separable pin and a box pin are disposed in the other end. In addition, a protrusion which protrudes toward the inner side of the tape from the side edge of the box pin on the side of the fastener tape is formed in the front end portion (the end portion opposite to the side of the element row) of the box pin.

In addition, fitting portions which can be fitted to each other are disposed to extend in the end portion of the separable pin on the side of the element row and the end portion of the box pin on the side of the element row, so that when the left and right element rows are coupled with each other, the separable pin and the box pin are prevented from being moved in the longitudinal direction of the element row. In addition, before the separable pin and the box pin are molded, the upper slider and the lower slider are allowed to pass through the element rows of the slide fastener in advance.

In the case of the slide fastener disclosed in Patent Document 2, the upper and lower sliders can be allowed to easily pass through the element rows before the separable pin and the box pin are molded, and the upper and lower sliders allowed to pass through the element rows are prevented from being detached from the element rows by the top stoppers disposed on the end portions of the element rows and the protrusion formed on the box pin.

Patent Document 1: Japanese Patent Application Laid-Open No. 2000-106917

Patent Document 2: Taiwanese Patent No. 526718

DISCLOSURE OF THE INVENTION

Problems to be Solved by the Invention

In the conventional upper-opening type or two-side-opening type slide fastener, in the case where the element row is formed with fastener elements having a continuous shape such as a coil shape or a zigzag shape, since the fastener elements have elasticity in themselves, the slide fastener has an excellent flexibility. However, for example, when an external force is exerted to the coupling head of the element row, the position of the coupling head may be shifted.

In addition, in general, in the conventional upper-opening type or two-side-opening type slide fastener, in order to appropriately couple the left and right element rows, it is necessary to slide the slider (upper slider) in the coupling direction in the state where the separable pin is sufficiently inserted to a predetermined position in the box or lower slider.

In other words, the separable pin is sufficiently inserted to the predetermined position in the box or the lower slider, so that the left and right element rows can be appropriately position-aligned. The slider is slid in the state where the separable pin is sufficiently inserted, so that the left and right element rows can be appropriately stabilized and coupled with each other.

However, in the case where the aforementioned upper-opening type or two-side-opening type slide fastener is used for clothes or the like, a user may unintentionally perform manipulation of opening or closing a general slide fastener. For example, when the left and right element rows are allowed to be coupled with each other, the slider (upper slider) may be slid in the coupling direction in the state where the separable pin is not sufficiently inserted in the box or the lower slider.

In this case, if the element row is configured with continuous-shaped fastener elements, since the fastener elements have elasticity as described above, when the left and right element rows are coupled with each other, for example, as illustrated in FIG. 16, the coupling head 92*a* of the fastener element 92 adjacent to the box pin 91 is not coupled at an appropriate position, so that the left and right element rows 93 are forcibly coupled with each other in the state where the position of the coupling head is shifted. In this manner, when the coupling is performed in the state where the coupling head 92*a* of the fastener element 92 is shifted, the coupling strength of the portion is greatly decreased. Consequently, there are problems in that cleavage in the coupling where the left and right element rows 93 in the coupled state are opened at this portion may easily occur and in that the element rows 93 are weak against a thrust force.

In addition, for example, in the slide fastener 71 disclosed in Patent Document 1, in other word, in the case of the slide fastener 71 where the protrusion 83 for increasing the coupling strength of the end portions of the element rows 75 is formed in the separable pin 76, when the left and right element rows 75 are coupled with each other, if the slider is slid in the state where the separable pin 76 is not sufficiently inserted into the box 78 or the lower slider, as illustrated in FIG. 17, there is a problem in that the coupling head 73*a* of the fastener element 73 adjacent to the box pin 77 is inserted in the lower side of the protrusion 83, so that the fastener elements 73 cannot be coupled with each other at an appropriate position.

In addition, similarly, in the slide fastener disclosed in Patent Document 2, when the left and right element rows are coupled with each other, if the slider is slid in the state where the separable pin is not sufficiently inserted into the box or the lower slider, there is a problem in that the fastener elements adjacent to the box pin are forcibly erroneously coupled with each other.

By taking into consideration the conventional problems, the invention is to provide a slide fastener capable of preventing left and right element rows from being erroneously coupled with each other and, particularly, preventing fastener elements adjacent to a box pin from being erroneously coupled with each other when left and right element rows are coupled with each other although a separable pin is not sufficiently inserted into a box or a lower slider.

Means for Solving the Problems

In order to achieve the above object, a slide fastener provided by the invention includes, as a basic configuration: fastener stringers where continuous-shaped fastener elements are attached to opposing side edge portions of a pair of left and right fastener tapes; at least one slider which is allowed to pass through the left and right element rows constructed with the fastener elements; a separable pin which is attached to one end portion of one element row of the left and right element rows; and a box pin which is attached to one end portion of an other element row, wherein in the slider, an upper blade and a lower blade are connected to front end portions of shoulder opening sides by a guide post, flange portions are disposed in left and right side edges of the upper blade and/or the lower blade, and rear openings are provided to rear end portions of the upper and lower blades, being characterized in that the separable pin has a projecting portion which is projected toward the box pin in an end portion area on a side of the element row, a difference (interval A−maximum value B) between an interval A between inner surfaces of the left and right flange portions in the rear end portion of the slider and a maximum value B of a dimension of the separable pin in a tape width direction is set to satisfy a relationship of "(dimension C of a portion of the box pin in the tape width direction corresponding to a portion of the separable pin having the maximum value B)<(interval A−maximum value B)<(element width D of the fastener element)", the maximum value B is set to be smaller than the element width D, and within the end portion area where the projecting portion of the separable pin is formed, a dimension E of the area in a tape length direction where the dimension of the separable pin in the tape width direction is larger than the difference between the interval A and the element width D (interval A−element width D) is set to satisfy a relationship of "(dimension E)>(length of one pitch of the fastener elements of the element row)×3−(dimension of a coupling head of the fastener element in the tape length direction)×3".

Also, the slide fastener according to the invention is preferably configured such that the two sliders are allowed to pass through the element rows in a direction so that the rear openings are allowed to face each other, and a stopper for stopping the sliders is disposed at an end portion of the box pin on the side of the element rows.

Further, the slide fastener according to the invention may be configured such that the one slider is allowed to pass through the element rows, and a box which the separable pin can be inserted into is disposed at the end portion of the box pin opposite to the side of the element row.

Further, the slide fastener according to the invention is preferably configured such that the box pin has a protrusion which protrudes toward the projecting portion of the separable pin, the projecting portion has an insert concave portion which the protrusion can be inserted into, and an end portion of the protrusion on the side of the element rows is located within a range of the dimension E of the separable pin in a state where the protrusion is inserted into the insert concave portion.

Further, the slide fastener according to the invention is preferably configured such that a dimension of a portion of the box pin in the tape width direction which is on a lower end side compared to the position facing the projecting portion of the separable pin is set to be larger than the dimension C.

Effects of the Invention

In the slide fastener according to the invention, the separable pin has the projecting portion which is projected toward the box pin in the end portion area of the separable pin on the side of the element row, and the difference (interval A−maximum value B) between the interval A between the inner surfaces of the left and right flange portions in the rear end portion of the slider and the maximum value B of the dimension of the separable pin in the tape width direction is set to satisfy the relationship of "(dimension C of the portion of the box pin in the tape width direction corresponding to the portion of the separable pin having the maximum value B)<(interval A−maximum value B)<(element width D of the fastener element)".

In addition, in the slide fastener according to the invention, the maximum value B is set to be smaller than the element width D, and within the end portion area where the projecting portion of the separable pin is formed, the dimension E of the area in the tape length direction where the dimension of the separable pin in the tape width direction is larger than the difference between the interval A and the element width D (interval A−element width D) is set to satisfy the relationship of "(dimension E)>(length of one pitch of the fastener elements of the element row)×3−(dimension of the coupling head of the fastener element in the tape length direction)×3".

Among the conventional upper-opening type slide fasteners having a separable bottom end stop or the conventional two-side-opening type slide fasteners having a reverse-opening lower slider, there are known slide fasteners where a protrusion protruding toward a box pin or a fitting portion is disposed in an end portion of a separable pin on a side of an element row in order to increase the coupling strength of the end portion of the element row as disclosed in Patent Document 1 or 2.

However, in the conventional slide fastener, the dimensions of the separable pin, the box pin, and the slider are set by considering only smooth insertion of the separable pin into the box or the reverse-opening lower slider or considering smooth sliding of the slider (upper slider), but the dimensions of the separable pin and the like are not strictly set by considering the erroneous coupling of the left and right element rows caused by the insufficient insertion of the separable pin. Accordingly, if the slider is slid in the element coupling direction in the state where the separable pin is insufficiently inserted, there is a problem in that the fastener elements are elastically deformed, so that the left and right element rows are forcibly coupled with each other at an erroneous position.

Therefore, the inventor contrives the invention where, in an upper-opening type or two-side-opening type slide fastener, although the slider is slid when the separable pin is insufficiently inserted, in order to prevent the left and right element rows from being erroneously coupled with each other, the left and right element rows are intentionally allowed not to be coupled with each other when the separable pin is insufficiently inserted, and the separable pin together with the slider is allowed to move.

In other words, in the slide fastener according to the invention, the dimensions of the separable pin, the box pin, and the slider are set to satisfy the predetermined relationships, so that in the case where the separable pin is insufficiently inserted when the left and right element rows are coupled with each other, although the slider (upper slider) is slid in the coupling direction, the separable pin is prevented from passing through the element guide lane of the slider, and the slider together with the separable pin is allowed to move in the coupling direction.

Therefore, in the slide fastener according to the invention, although the slider is slid in the coupling direction when the separable pin is insufficiently inserted, the left and right element rows are intentionally allowed not to be coupled with each other. Therefore, it is possible to securely prevent the decrease in the coupling strength caused by the erroneous coupling of the left and right element rows or the weakness against a thrust force in comparison with the conventional slide fastener.

In addition, when the separable pin is insufficiently inserted, the left and right element rows are not coupled with each other, so that a user using the slide fastener according to the invention can immediately recognize that the separable pin is insufficiently inserted. Therefore, the user manipulates the separable pin again so as to slide the slider in the state where the separable pin is securely inserted into the box or the like, so that the left and right element rows can be appropriately stabilized and coupled with each other.

In the slide fastener according to the invention, two sliders, that is, the upper slider and the lower slider are allowed to pass through the left and right element rows in the direction where the corresponding rear openings are allowed to face, and the stopper for stopping the sliders is disposed at the end portion opposite to the element row side of the box pin. Therefore, the slide fastener according to the invention can be configured as the two-side-opening type slide fastener.

In addition, in the slide fastener according to the invention, one slider may be allowed to pass through the left and right element rows, and the box which the separable pin can be inserted into may be disposed at the end portion opposite to the element row side of the box pin. Therefore, the slide fastener according to the invention can be configured as the upper-opening type slide fastener.

In addition, in the slide fastener according to the invention, the box pin has the protrusion which protrudes toward the projecting portion of the separable pin; the projecting portion has the insert concave portion which the protrusion can be inserted into; and the end portion of the protrusion on the side of the element rows is located within a range of the dimension E of the separable pin in the state where the protrusion is inserted into the insert concave portion. Therefore, in the slide fastener according to the invention, when the left and right element rows are coupled with each other, it is possible to securely perform position alignment of the separable pin and the box pin. In addition, when the element rows are coupled with each other, although a thrust force in the front-rear direction is exerted on the box pin and the separable pin, the positions of the box pin and the separable pin are prevented from being shifted in the front-rear direction, so that the coupled state of the element rows are stably maintained.

Furthermore, in the slide fastener according to the invention, a dimension of a portion of the box pin in the tape width direction which is on the lower end side compared to the position facing the projecting portion of the separable pin is set to be larger than the dimension C. Therefore, when the separable pin having the projecting portion is inserted into, for example, a reverse-opening slider or a box, a space which a portion on the lower end side compared to the projecting portion of the separable pin is inserted into can be limited by the box pin. Accordingly, it is possible to smoothly guide the separable pin to a predetermined position, and it is possible to stably maintain a relative position relationship between the separable pin and the box pin before the left and right element rows are coupled with each other. Therefore, it is possible to securely prevent the left and right element rows from being erroneously coupled with each other.

DESCRIPTION OF REFERENCE SIGNS

Figure 1:
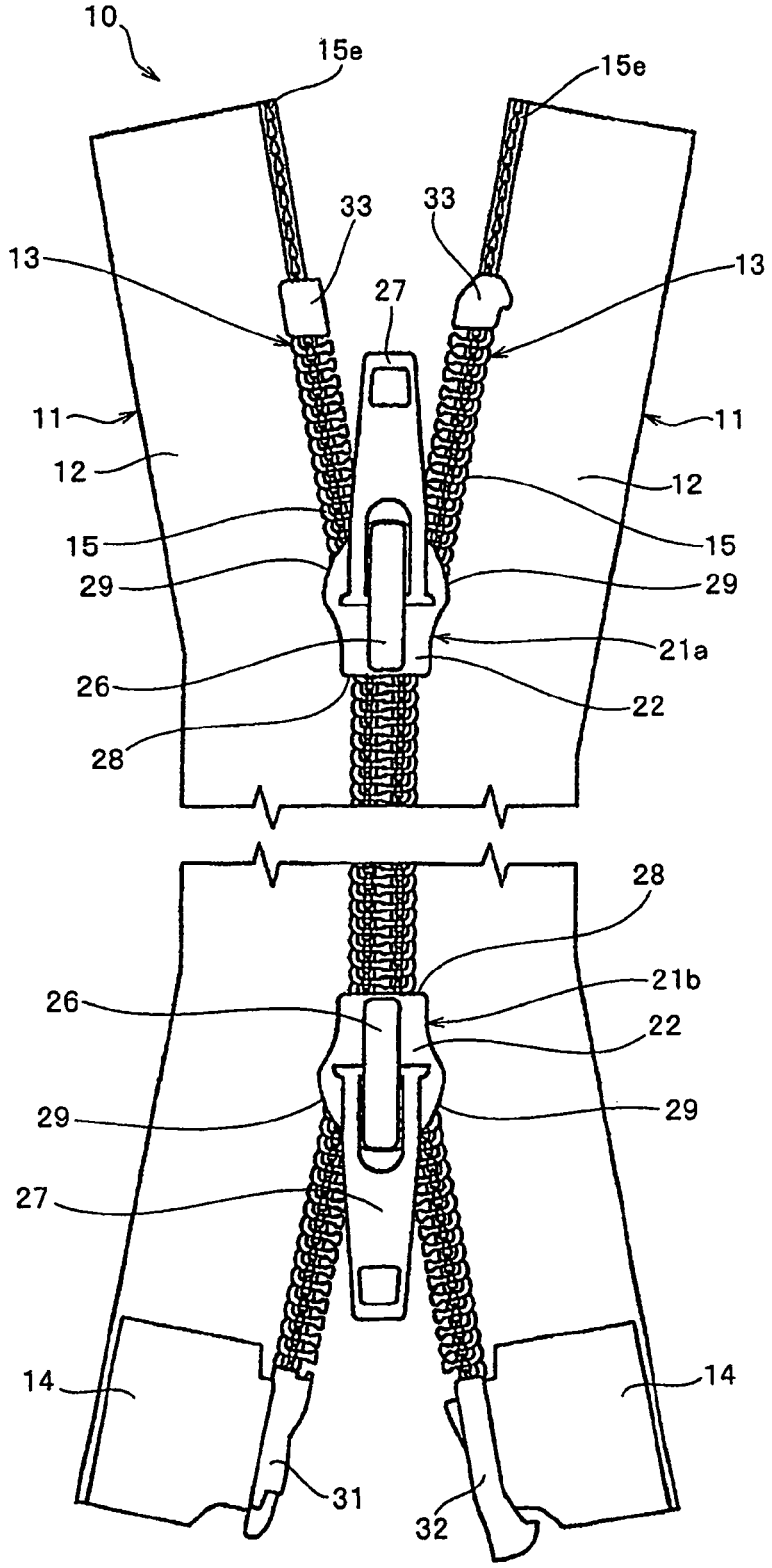
FIG. 1 is a front view illustrating a slide fastener according to a first embodiment of the invention.

10: slide fastener
11: fastener stringer
12: fastener tape
13: element row
14: reinforcing portion
15: fastener element
15*a*: coupling head
15*b*: upper leg portion
15*c*: lower leg portion
15*d*: connecting portion
15*e*: core thread
21*a*: first slider
21*b*: second slider
22: upper blade
23: lower blade
24: flange portion
25: guide post
26: tab attaching post
27: tab
28: rear opening
29: shoulder opening
30: locking pawl
31: separable pin
31*a*: separable pin body
31*b*: projecting portion
31*c*: insert concave portion

31*d*: engaged end portion
31*e*: insert piece
32, 32': box pin
32*a*, 32*a*': box pin body
32*b*: stopper
32*c*, 32*c*': protrusion
32*d*: cut-out
33: top stopper
34: box
34*a*: separable-pin-insertion hole
40: slide fastener
50: slide fastener
51: separable pin
51*a*: separable pin body
51*b*: projecting portion
51*c*: insert concave portion
51*d*: first notch portion
51*e*: insert piece
52: box pin
52*a*: box pin body
52*b*: stopper
52*c*: protrusion
52*d*: second notch portion

BEST MODE FOR CARRYING OUT THE INVENTION

Hereinafter, the preferred embodiments of the invention will be described in detail with reference to the drawings. In addition, the invention is not limited to the embodiments, but various modifications can be made if substantially the same configuration as that of the invention is provided and the same function and effects as those of the invention are obtained.

For example, in the later-described embodiments, element rows are formed by sewing a coil-like fastener element to facing side edge portions of a fastener tape. However, the invention is not limited thereto, but the element rows may be formed by sewing a zigzag shaped fastener element instead of the coil-like fastener element.

First Embodiment

Figure 2:
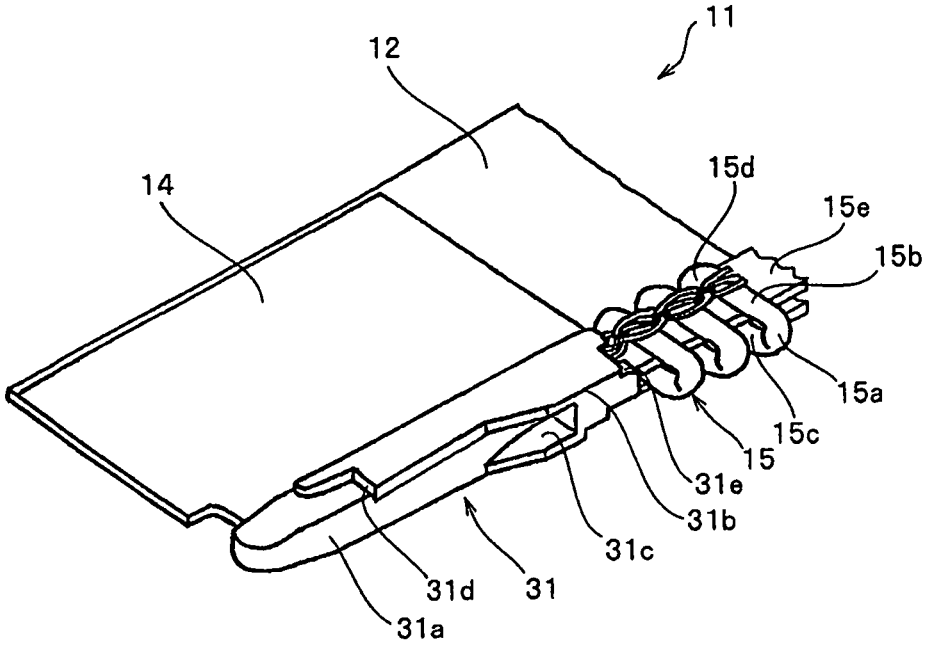
FIG. 2 is a main perspective view illustrating enlargement of a separable pin of the slide fastener.
Figure 3:
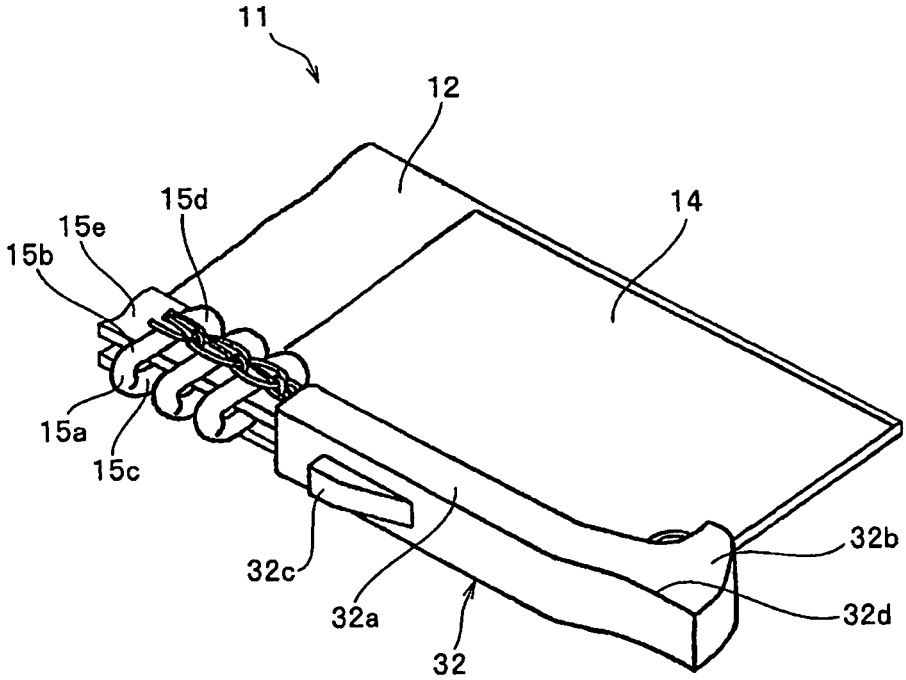
FIG. 3 is a main perspective view illustrating enlargement of a box pin of the slide fastener.
Figure 4:
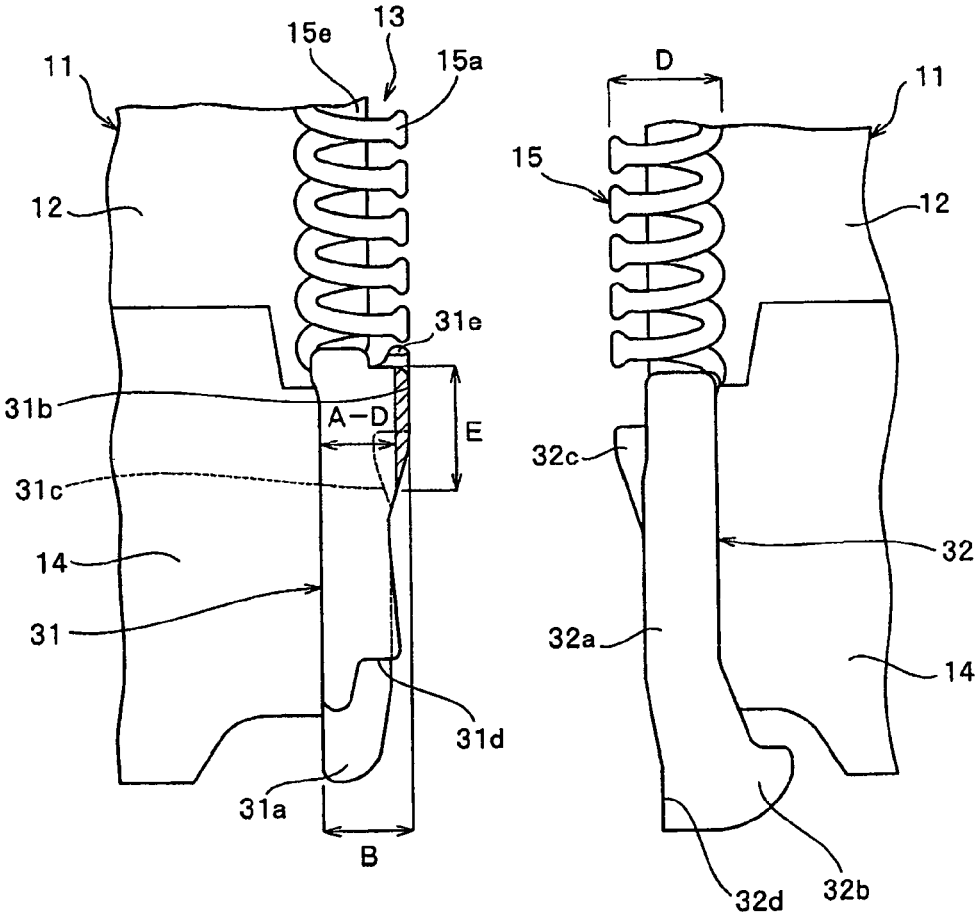
FIG. 4 is an enlarged main view illustrating sizes of the separable pin and the box pin of the slide fastener.
Figure 5:
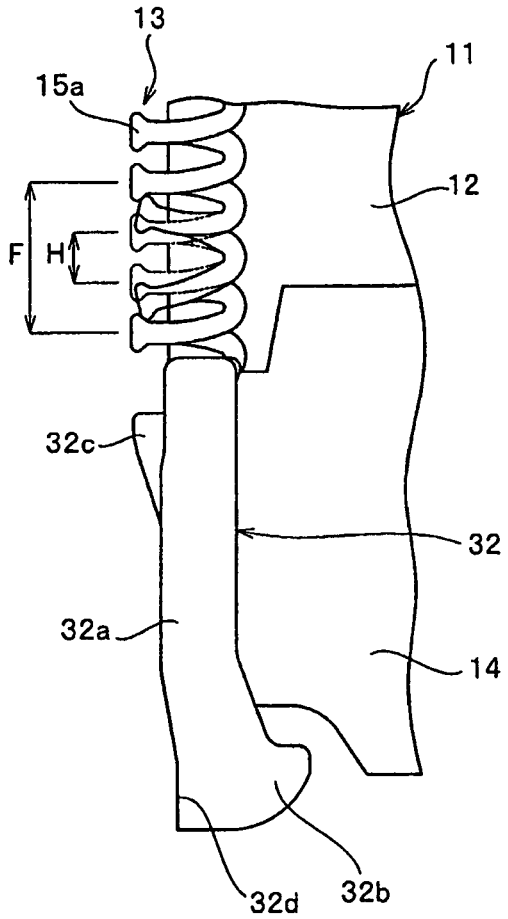
FIG. 5 is an explanatory view illustrating a relationship between a pitch and a coupling head of an element in the slide fastener.

FIG. 1 is a front view illustrating a slide fastener according to a first embodiment of the invention; FIG. 2 is a main perspective view illustrating enlargement of a separable pin of the slide fastener; and FIG. 3 is a main perspective view illustrating enlargement of a box pin of the slide fastener. In addition, FIG. 4 is an enlarged main view illustrating sizes of the separable pin and the box pin of the slide fastener, and FIG. 5 is an explanatory view illustrating a relationship between a pitch and a coupling head of an element in the slide fastener.

The slide fastener 10 according to the first embodiment is a slide fastener used for clothes, for example, a long coat whose left and right front parts are opened and closed. The slide fastener 10 includes fastener stringers 11 where element rows 13 are provided to facing side edge portions of a pair of left and right fastener tapes 12, reinforcing portions 14 which reinforce lower end portions of the fastener tapes 12, a first slider (upper slider) 21*a* for upper-opening and a second slider (lower slider) 21*b* for reverse-opening which are allowed to pass through the left and right element rows 13, a synthetic resin separable pin 31 which is attached to a lower end portion of the left-side fastener stringer 11, a synthetic resin box pin 32 which is attached to a lower end portion of the right-side fastener stringer 11, and top stoppers 33 which are attached to upper ends of the left and right element rows 13.

The fastener stringers 11 include a pair of left and right fastener tapes 12 which are woven or knitted and the element rows 13 which are attached to the facing tape side edge portions of the fastener tapes 12. The element rows 13 are formed with coil-like continuous fastener elements 15 which are formed with mono-filament made of a synthetic resin such as polyamide or polyester.

Each of the fastener elements 15 includes coupling heads 15*a*, upper and lower leg portions 15*b* and 15*c* which are disposed parallel to each other on the fastener tape 12 to extend from the coupling heads 15*a*, and connecting portions 15*d* which connect the extension end portions of the upper and lower leg portions 15*b* and 15*c* to the adjacent element in the longitudinal direction (forward-backward direction) of the tape. A core thread 15*e* is inserted inside each of the coil-like fastener elements 15, and in the state where the lower leg portions 15*c* are disposed on the fastener tape 15 side, the upper and lower leg portions 15*b* and 15*c* and the core thread 15*e* are sewed to the tape side edge portion by using a sewing thread to be fixed to each of the fastener tapes 12.

The reinforcing portion 14 is formed by coating a resin film (for example, a thermoplastic elastomer film) on the front and rear surfaces of the fastener tape 12 and performing ultrasonic solder welding.

Conventional sliders which are generally known may be used for the first and second sliders 21*a* and 21*b*. More specifically, each of the first and second sliders 21*a* and 21*b* includes an upper blade 22, a lower blade 23, upper and lower flange portions 24 which are disposed in the perpendicular directions (the approaching directions) along the left and right side end edges of the upper and lower blades 22 and 23, a guide post 25 which connects the one-end-side central portions of the upper and lower blades 22 and 23 with a predetermined gap, a locking pawl 30 which is disposed to the upper blade 22 to be engaged with the element row 13, a gate-shaped tab attaching post 26 which is disposed on the upper plane of the upper blade 22, and a tab 27 which is attached to the tab attaching post 26 in a manner that the tab can be rotated in the forward and backward directions. In addition, in the invention, for example, according to types of the fastener, the flange portion 24 may be formed on only the one of the upper and lower blades 22 and 23.

In addition, rear openings 28 are provided to the other end (rear end portion) sides of the first and second sliders 21*a* and 21*b*, and shoulder openings 29 are provided to left and right sides of the guide post 25 in the one end sides of the first and second sliders 21*a* and 21*b*. In addition, element guide lanes surrounded by the upper and lower blades 22 and 23 and the upper and lower flange portions 24 are formed in the inner portions of the first and second sliders 21*a* and 21*b*. The element guide lanes are branched by the guide post 25 to be two branches from the rear opening 28 of the slider toward the shoulder opening 29, so that the element guide lanes penetrate the inner portion of the slider in the Y shape. Furthermore, the locking pawl 30 is disposed so as to protrude from the upper blade 22 of the slider 21*a* and 21*b* into the element guide lane when the sliding manipulation of the slider 21*a* and 21*b* is not performed, and the locking pawl 30 is disposed so as to be recessed from the element guide lane when the slider 21*a* and 21*b* is slid by pulling the tab 27.

The first and second sliders 21*a* and 21*b* are allowed to pass through the element rows 13 so that the corresponding rear openings 28 face each other. In addition, in order to prevent the first and second sliders 21*a* and 21*b* from being detached from the upper ends of the element rows 13, the top stoppers 33 are fixed to the upper ends of the left and right element rows 13 by molding.

As illustrated in FIG. 2, the separable pin 31 is integrally fixed to the lower end portion of the left-side fastener stringer 11 so as to be continuous with the lower end of the left-side element row 13. The separable pin 31 includes a separable pin body 31*a* having a substantial rectangular column shape, a projecting portion 31*b* which is projected toward the box pin 32 in an end portion area of the separable pin body 31*a* on the side of the element row 13, an insert concave portion 31*c* which is formed in a concave shape in the projecting portion 31*b* and which the later-described protrusion 32*c* of the box pin 32 can be inserted into, an engaged end portion 31*d* which is formed on the upper surface side (the side facing the upper blade 22 of the second slider 21*b*) of the separable pin body 31*a* and which a locking pawl 30 of the second slider 21*b* can be engaged with, and an insert piece 31*e* which protrudes upwards from the front end portion of the projecting portion 31*b*. In addition, the end portion area where the projecting portion 31*b* is formed is an area closer to the element row 13 side rather than the central area in the tape length direction of the separable pin 31.

As illustrated in FIG. 3, the box pin 32 is integrally fixed to the lower end portion of the right-side fastener stringer 11 so as to be continuous with the lower end of the right-side element row 13. The box pin 32 includes a box pin body 32*a*, a hook-shaped stopper 32*b* which is formed at the side opposite to the side facing the separable pin 31 in the lower end portion of the box pin body 32*a*, and a protrusion 32*c* having a trapezoidal shape as seen from the top plane, which is disposed to protrude toward the separable pin 31 from the side surface of the box pin body 32*a* facing the separable pin 31. In addition, a small cut-out 32*d* is formed at the side edge facing the separable pin 31 in the lower end portion of the box pin body 32*a* in order to prevent the interference of the guide post 25 of the second slider 21*b* when the second slider 21*b* is moved to the lower end position (for example, refer to FIG. 6).

Figure 8:
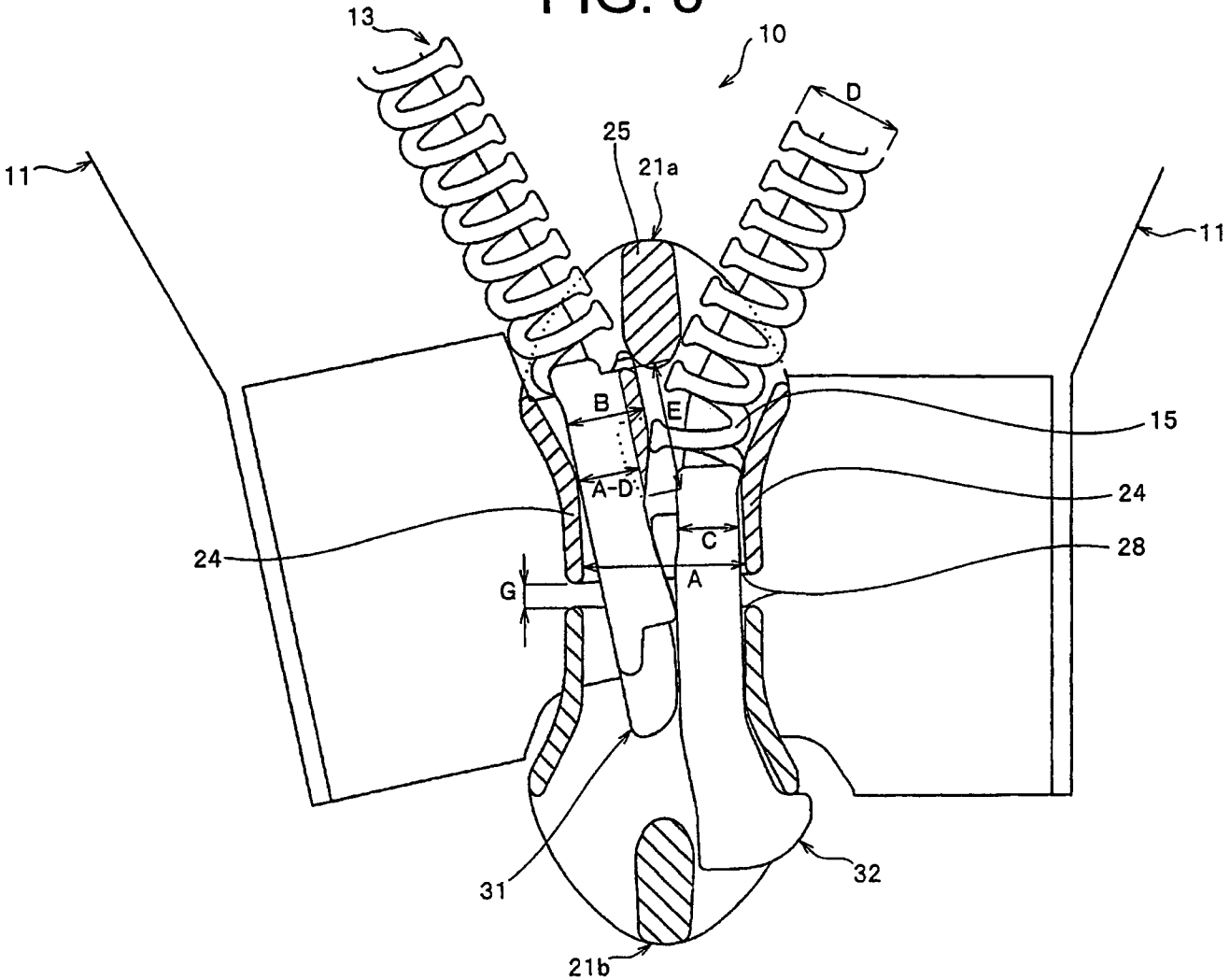
FIG. 8 is a main cross-sectional view illustrating a state where a first slider is allowed to be slid in an element coupling direction in the state where the separable pin is insufficiently inserted in the slide fastener.

In the slide fastener 10 according to the first embodiment, as illustrated in FIGS. 4 and 8, an interval between inner surfaces of the left and right flange portions 24 in the rear opening side end portion of the slider 21*a* and 21*b* is defined by A, and a maximum value of a dimension of the separable pin 31 in the tape width direction is defined by B. In this case, the difference between the interval A of the slider and the maximum value B of the separable pin 31 (interval A−maximum value B) is set to satisfy a first relationship where (dimension C of a portion of the box pin 32 in the tape width direction corresponding to the portion of the separable pin 31 having the maximum value B)<(interval A−maximum value B)<(element width D of the fastener element 15). In this case, the dimension of the portion of the box pin 32 in the tape width direction on the lower end side compared to the position facing the projecting portion 31*b* of the separable pin 31 is set to be larger than the dimension C.

In addition, the slide fastener 10 according to the first embodiment is configured so that the maximum value B of the separable pin 31 is smaller than the element width D, in other words, so that a second relationship of (maximum value B)<(element width D) is satisfied.

In addition, in the slide fastener 10 according to the first embodiment, within the end portion area where the projecting portion 31*b* of the separable pin 31 is formed, the dimension of the area in the tape length direction where the dimension of the separable pin 31 in the tape width direction is larger than the difference between the interval A and the element width D (interval A−element width D) is defined by E (refer to FIG. 4); the length of 3 pitches of the fastener elements 15 of the element row 13 is defined by F; and the size of "(length F of 3 pitches of elements)−(dimension of coupling head 15*a* of fastener element 15 in tape length direction)×3" is defined by H (refer to FIG. 5). In this case, the slide fastener 10 is configured so as to satisfy a third relationship of "(dimension E)>(size H)". In addition, the pitch of the fastener element 15 is a distance (interval) between the center of the coupling head of a fastener element 15 in the tape length direction and the center of the coupling head of a fastener element 15 adjacent to the fastener element 15 in the tape length direction.

In the slide fastener 10 having the aforementioned configuration according to the first embodiment, in the case where the left and right element rows 13 are coupled with each other, first, each of the first and second sliders 21*a* and 21*b* which are allowed to pass through the right-side element row 13 is slid to the lower end position (distal end position in the element separating direction) of each of the sliders 21*a* and 21*b*. At this time, since the stopper 32*b* is formed in the box pin 32, although the first and second sliders 21*a* and 21*b* is slid in the downward direction, that is, in the element separating direction, it is possible to prevent the sliders from being detached from the element row 13.

In addition, in this case, the lower end position of the second slider 21*b* is the position of the second slider 21*b* at the time when the upper and lower flange portions 24 of the second slider 21*b* contact with the stopper 32*b*, and the lower end position of the first slider 21*a* is the position of the first slider 21*a* at the time when the rear end of the first slider 21*a* contacts with the second slider 21*b* which is disposed at the lower end position.

Subsequently, the separable pin 31 is inserted into the second slider 21*b* which is moved to the lower end position. More specifically, in the state where the rear opening side end portion of the first slider 21*a* and the rear opening side end portion of the second slider 21*b* are in contact with each other, the separable pin 31 is inserted from the left-side shoulder opening 29 of the first slider 21*a*, and the separable pin 31 is completely inserted into the element guide lane of the second slider 21*b* through the element guide lane of the first slider 21*a*.

Figure 6:
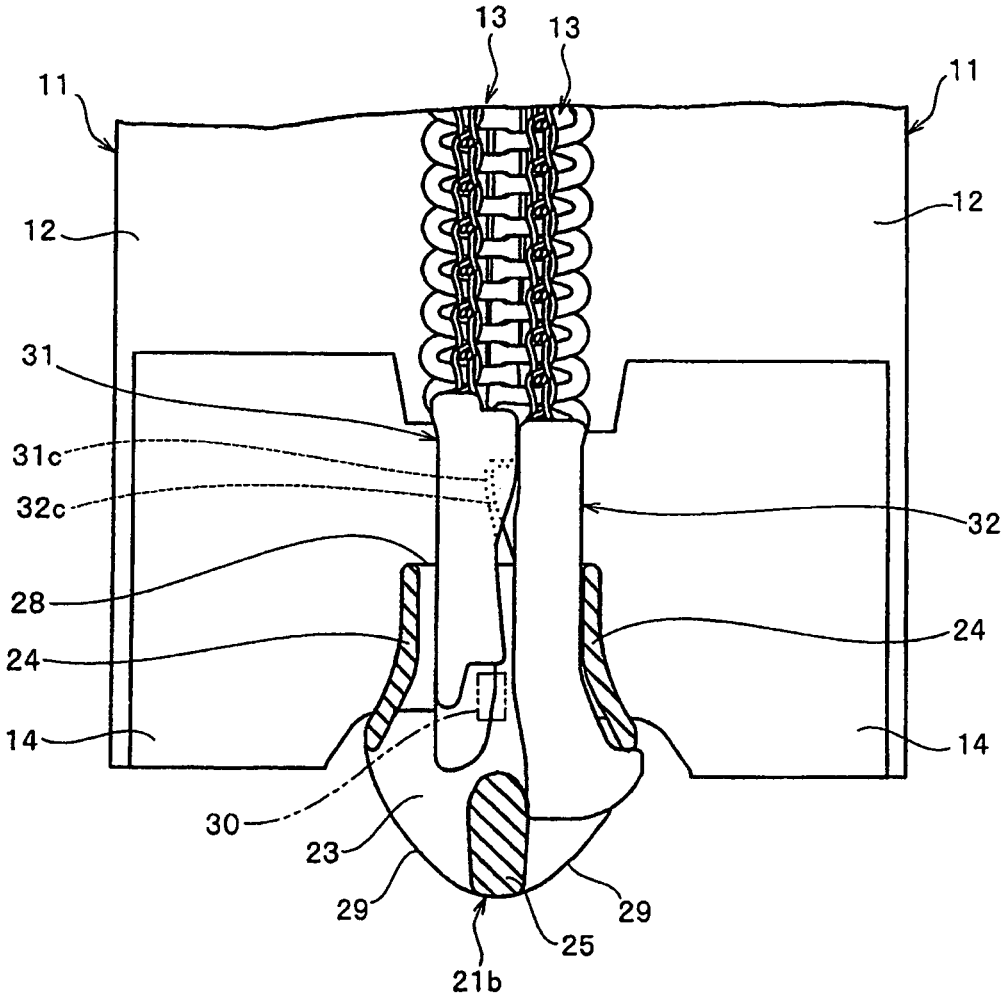
FIG. 6 is a main cross-sectional view illustrating a state where left and right element rows are coupled with each other in the slide fastener.

Therefore, the separable pin 31 is retained in the second slider 21*b* in the state where the separable pin 31 is approximately parallel to the box pin 32. At this time, the protrusion 32*c* of the box pin 32 is inserted into the insert concave portion 31*c* of the separable pin 31, and the end portion of the protrusion 32*c* on the side of the element row 13 contacts with a portion of the separable pin 31 in the insert concave portion 31*c*, so that the separable pin 31 and the box pin 32 can be position-aligned. Particularly, in this case, in the state where the protrusion 32*c* is inserted into the insert concave portion 31*c*, the end portion of the protrusion 32*c* on the side of the element row 13 is located in a range of the dimension E of the separable pin 31. Therefore, the separable pin 31 and the box pin 32 can be securely positioned. After that, the first slider 21*a* is slid in the upward direction, that is, the element coupling direction, so that as illustrated in FIG. 6, the left and right element rows 13 can be stabilized and coupled with each other.

Particularly, in this case, in the slide fastener 10 according to the first embodiment, when the separable pin 31 is inserted from the left-side shoulder opening 29 of the first slider 21*a* into the second slider 21*b*, since the maximum value B of the dimension of the separable pin 31 in the tape width direction is set to be smaller than the element width D of the element rows 13 based on the second relationship, the separable pin 31 can be easily inserted into the element guide lanes of the sliders 21*a* and 21*b* where the element rows 13 can be allowed to pass, so that it is possible to smoothly perform the insertion of the separable pin 31.

In addition, after the separable pin 31 is inserted into the second slider 21*b*, when the first slider 21*a* is slid in the element coupling direction, since the (interval A−maximum value B) is set to be larger than the dimension C of the box pin 32 based on the first relationship, in other words, since the interval A of the slider is set to be larger than a sum of the maximum value B of the separable pin 31 and the dimension C of the box pin 32, if the separable pin 31 is completely inserted into the second slider 21*b*, the left and right element rows 13 can be coupled with each other by smoothly sliding the first slider 21*a* in the element coupling direction.

Figure 7:
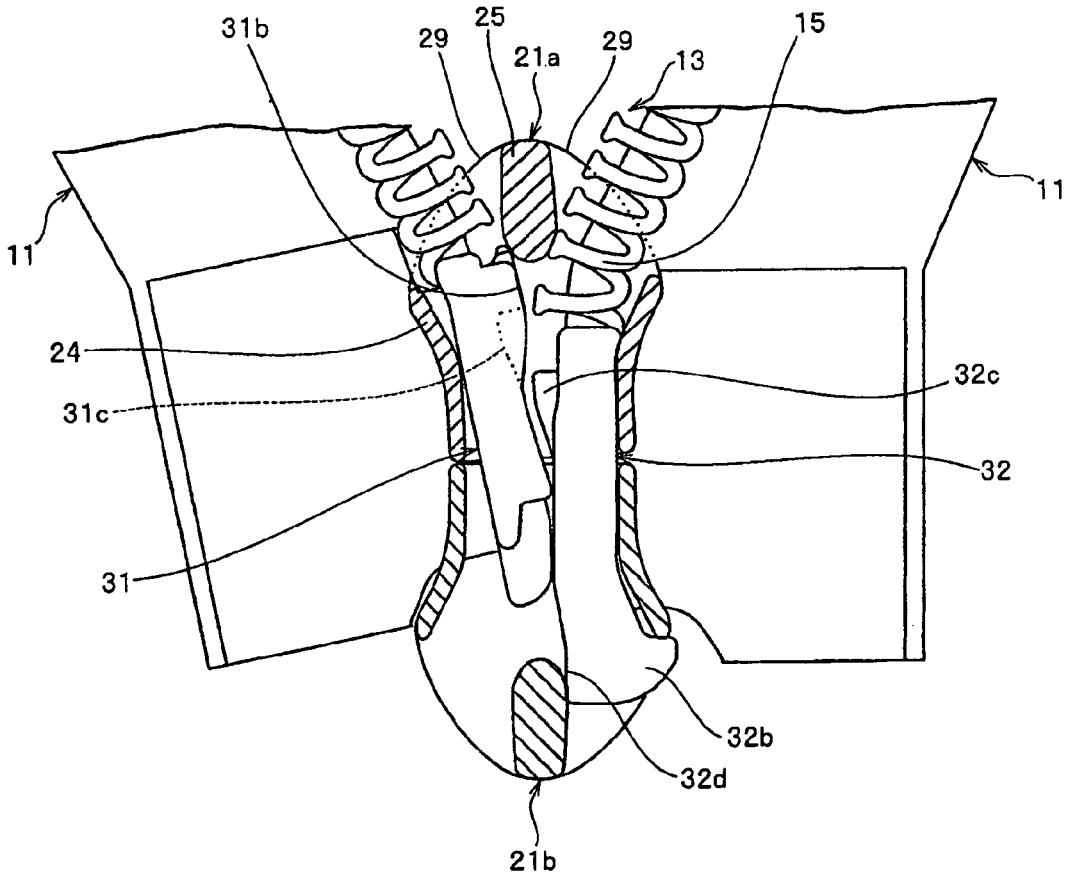
FIG. 7 is a main cross-sectional view illustrating a state where the separable pin is insufficiently inserted in the slide fastener.

Next, in the slide fastener 10, when the left and right element rows 13 are coupled with each other, for example, as illustrated in FIG. 7, the case where the separable pin 31 is not completely inserted into the second slider 21*b* and the first slider 21*a* is slid in the coupling direction in the state where the separable pin 31 is not sufficiently inserted is described.

In this case, as illustrated in FIG. 8, since the (interval A−maximum value B) is set to be smaller than the element width D based on the first relationship, in other words, since the interval A of the slider is set to be smaller than a sum of the maximum value B of the separable pin 31 and the element width D, when the first slider 21*a* is slid by a distance of a length G in the coupling direction, the projecting portion 31*b* of the separable pin 31 and the right-side element row 13 contact with each other to interfere with each other, and the side surface of the separable pin 31 on the side of the fastener tape 12 contacts with the left-side flange portion 24 of the slider. As a result, the separable pin 31 is retained in the slanted state with respect to the box pin 32, so that it is possible to prevent the separable pin 31 from passing through an inner portion of the first slider 21*a*.

In addition, if the first slider 21*a* is slid in the coupling direction in the state where the projecting portion 31*b* of the separable pin 31 and the right-side element row 13 contact with each other, since the dimension E of the separable pin 31 is set to be larger than the size H in the element row 13 based on the third relationship of the slide fastener 10, for example, as illustrated in FIG. 5, although the two fastener elements 15 adjacent to the right-side element row 13 are elastically deformed in the separation direction, the projecting portion 31*b* of the separable pin 31 is prevented from inserting into the gap formed by the elastic deformation of the fastener elements 15, so that it is possible to securely prevent the projecting portion 31*b* and the right-side element row 13 from being erroneously coupled with each other.

Accordingly, if the first slider 21*a* is slid in the coupling direction, the separable pin 31 that is insufficiently inserted into the second slider 21*b* can be prevented from passing through the inner portion of the first slider 21*a* and prevented from being coupled with the right-side element row 13. As a result, since the separable pin 31 loses the place to move, the separable pin 31 together with the first slider 21*a* moves upwards in the state where the separable pin 31 is inserted into the first slider 21*a*.

In other words, in the slide fastener 10 according to the first embodiment, although the first slider 21*a* is slid in the element coupling direction in the state where the separable pin 31 is insufficiently inserted into the second slider 21*b*, since the separable pin 31 together with the first slider 21*a* moves upwards, the left and right element rows 13 can be intentionally allowed not to be coupled with each other. As a result, it is possible to securely prevent the problems of the conventional slide fastener such as the decrease in the coupling strength caused by the erroneous coupling of the left and right element rows 13 or the weakness against a thrust force.

In addition, in the case where the separable pin 31 is insufficiently inserted, since the left and right element rows 13 are not coupled with each other and the separable pin 31 together with the first slider 21*a* moves, a user using the slide fastener 10 according to the first embodiment can immediately recognize that the separable pin 31 is insufficiently inserted. Therefore, the user manipulates the separable pin 31 again so as to slide the first slider 21*a* in the state where the separable pin 31 is securely inserted into the second slider 21*b*, so that the left and right element rows 13 can be appropriately coupled with each other.

Second Embodiment

Next, a slide fastener according to a second embodiment of the invention will be described.

Figure 9:
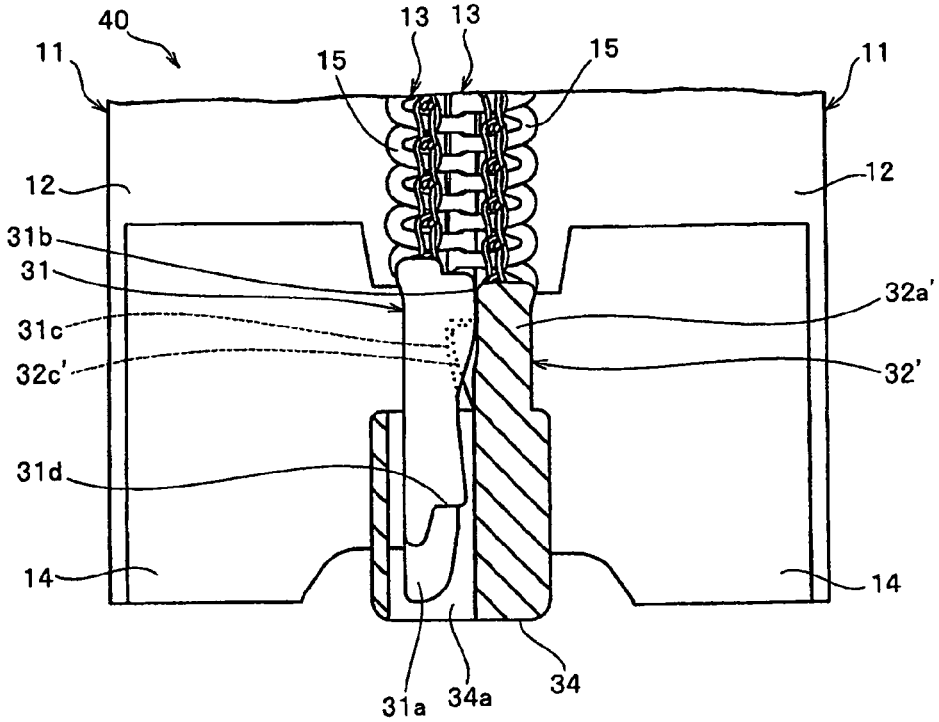
FIG. 9 is a main cross-sectional view illustrating main components of a slide fastener according to a second embodiment.
Figure 10:
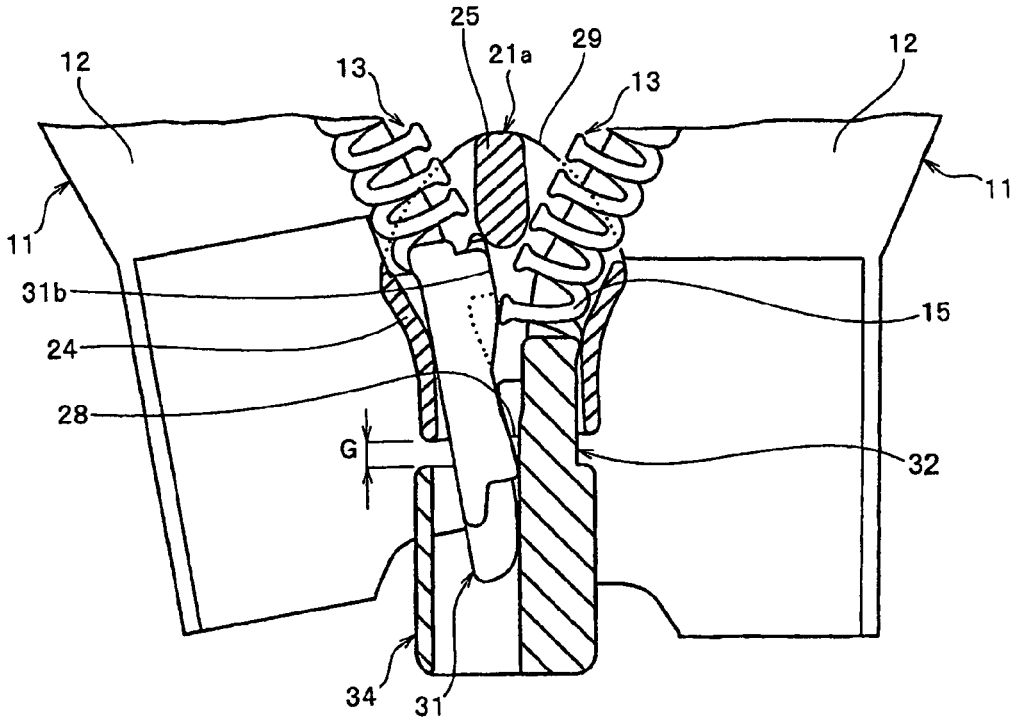
FIG. 10 is a main cross-sectional view illustrating a state where a slider is allowed to be slid in an element coupling direction in a state where the separable pin is insufficiently inserted.

Herein, FIG. 9 is a main cross-sectional view illustrating main components of a slide fastener according to a second embodiment, and FIG. 10 is a main cross-sectional view illustrating a state where a slider is allowed to be slid in an element coupling direction in the state where the separable pin is insufficiently inserted.

The slide fastener 40 according to the second embodiment is a slide fastener attached with a separable bottom end stop. Instead of using the reverse-opening second slider (lower slider) 21*b* of the aforementioned slide fastener 10 according to the first embodiment, a box 34 is integrally formed in a box pin 32', and the separable bottom end stop is configured with a separable pin 31, the box pin 32', and the box 34.

Accordingly, the other configurations of the slide fastener 40 are the same as those of the first embodiment except to the configuration where the box 34 is provided instead of the aforementioned second slider 21*b* according to the first embodiment. Therefore, the parts and elements having the same configurations as those described in the first embodiment are denoted by the same reference numerals, and thus, the description thereof is omitted.

The slide fastener 40 according to the second embodiment includes fastener stringers 11 where element rows 13 are provided to facing side edge portions of a pair of left and right fastener tapes 12, reinforcing portions 14 which reinforce lower end portions of the fastener tapes 12, a single first slider 21*a* (not shown) which is allowed to pass through the left and right element rows 13, a separable pin 31 which is attached to a lower end portion of the left-side element row 13, a box pin 32' which is attached to a lower end portion of the right-side element row 13, a synthetic resin box 34 which is integrally formed in the box pin 32', and top stoppers 33 (not shown) which are attached to upper ends of the left and right element rows 13.

The box pin 32' is integrally fixed to the lower end portion of the fastener stringer 11 so as to be continuous with the lower end of the right-side element row 13. The box pin 32' includes a box pin body 32*a*' and a protrusion 32*c*' having a trapezoidal shape as seen from the top plan, which protrudes from the side surface of the box pin body 32*a*' facing the separable pin 31 toward the separable pin 31.

The box 34 is disposed in a rectangular shape in the lower half portion of the box pin 32', and a separable-pin-insertion hole 34*a* which the separable pin 31 can be inserted into is formed in an inner portion of the box 34.

In addition, in the slide fastener 40 according to the second embodiment, the relationships among the interval A between the inner surfaces of the left and right flange portions 24 in the rear opening side end portion of the first slider 21*a* (not shown), the maximum value B of the dimension of the separable pin 31 in the tape width direction, the dimension C of the portion of the box pin in the tape width direction corresponding to the portion of the separable pin 31 having the maximum value B, the element width D of the element rows 13, the dimension E of the area in the tape length direction where the dimension of the separable pin 31 in the tape width direction is larger than the difference between the interval A and the element width D (interval A−element width D), and the size H of (length F of 3 pitches of elements)−(dimension of coupling head 15*a* of fastener element 15 in tape length direction)×3 are set to be the same as those of the aforementioned first embodiment.

In the slide fastener 40 having the aforementioned configurations according to the second embodiment, it is possible to obtain the same functions and effects as those of the aforementioned first embodiment.

In other words, in the case where the left and right element rows 13 of the slide fastener 40 are coupled with each other, first, the slider 21*a* which is allowed to pass through the right-side element row 13 is slid down to the lower end position contacting with the box 34. Subsequently, the separable pin 31 is inserted from the left-side shoulder opening 29 of the slider 21*a*, so that the separable pin 31 is completely inserted into the separable-pin-insertion hole 34*a* of the box 34. Therefore, the separable pin 31 is retained in the state where the separable pin 31 is approximately parallel to the box pin 32'. After that, the slider 21*a* is slid in the upward direction, that is, in the element coupling direction, so that as illustrated in FIG. 9, the left and right element rows 13 are stabilized and coupled with each other.

On the other hand, in the case where, when the left and right element rows 13 are coupled with each other, the separable pin 31 is not completely inserted into the box 34 and the slider 21*a* is slid by a distance of a length G in the element coupling direction in state where the separable pin 31 is insufficiently inserted, as illustrated in FIG. 10, the projecting portion 31*b* of the separable pin 31 and the right-side element row 13 contact with each other to interfere with each other, and the side surface of the separable pin 31 on the side of the fastener tape 12 contacts with the left-side flange portion 24 of the slider 21*a*. As a result, the separable pin 31 is retained in the slanted state with respect to the box pin 32', so that it is possible to prevent the separable pin 31 from passing through an inner portion of the slider 21*a*.

In addition, if the slider 21*a* is slid in the element coupling direction in the state where the projecting portion 31*b* of the separable pin 31 and the right-side element row 13 contact with each other, the separable pin 31 that is insufficiently inserted into the box 34 can be prevented from passing through the inner portion of the slider, and can be prevented from being coupled with the right-side element row 13, so that the separable pin 31 together with the slider 21*a* moves upwards in the state where the separable pin 31 is inserted into the slider 21*a*. Therefore, the left and right element rows 13 can be intentionally allowed not to be coupled with each other, so that it is possible to securely prevent the decrease in the coupling strength caused by the erroneous coupling of the left and right element rows 13 or the weakness against a thrust force.

Third Embodiment

Next, a slide fastener according to a third embodiment of the invention will be described.

Figure 11:
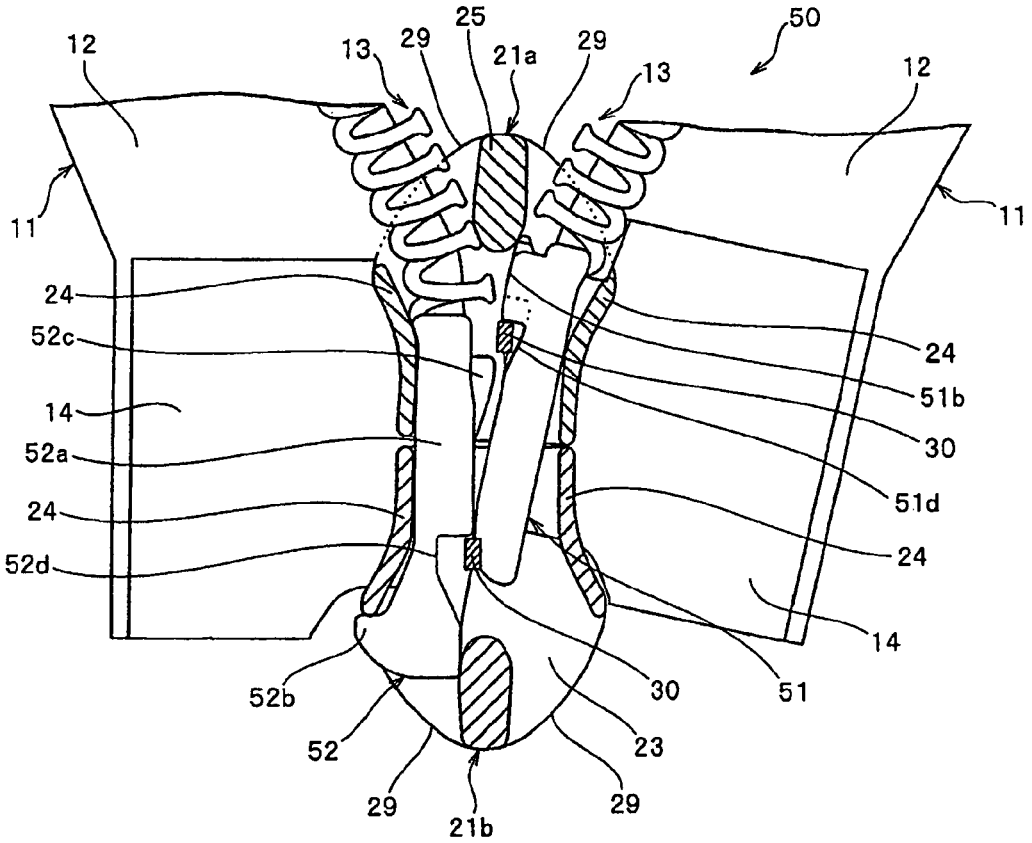
FIG. 11 is a main cross-sectional view illustrating main components of a slide fastener according to a third embodiment.
Figure 12:
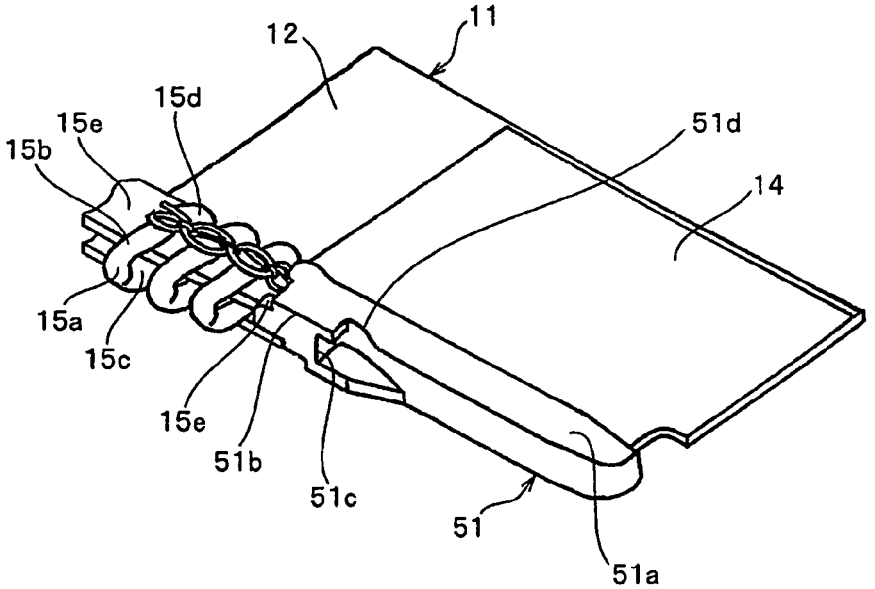
FIG. 12 is a main perspective view illustrating enlargement of a separable pin of the slide fastener.
Figure 13:
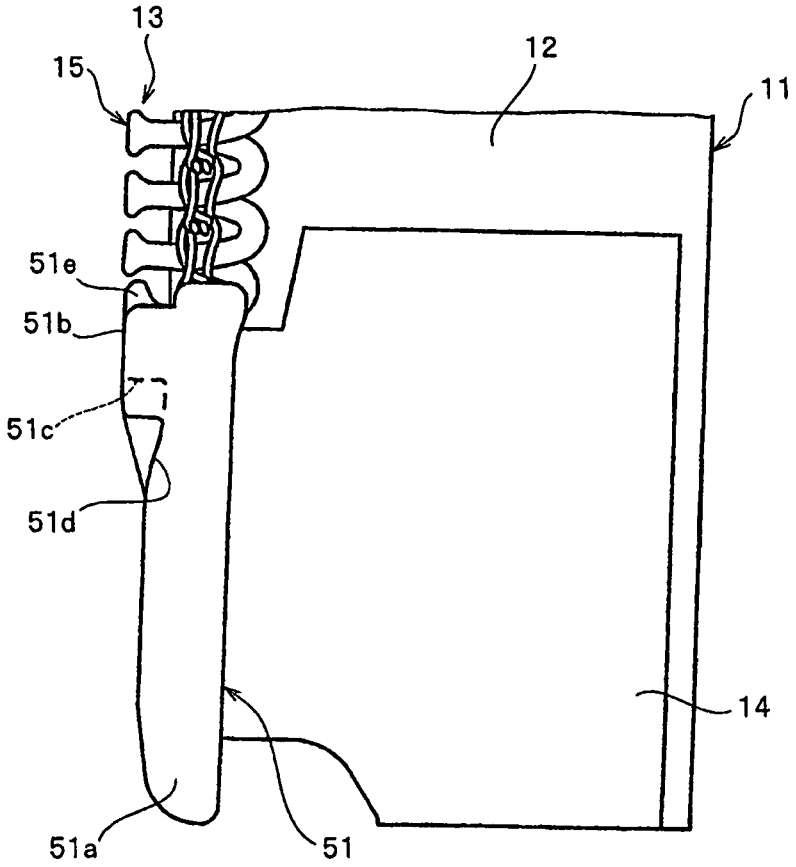
FIG. 13 is a main perspective view illustrating enlargement of a box pin of the slide fastener.
Figure 14:
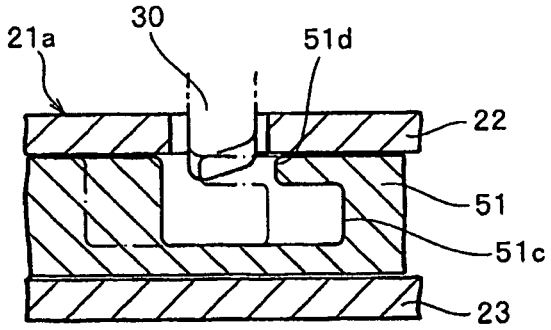
FIG. 14 is a view for explaining a relationship between the separable pin and a locking pawl of a slider of the slide fastener.
Figure 15:
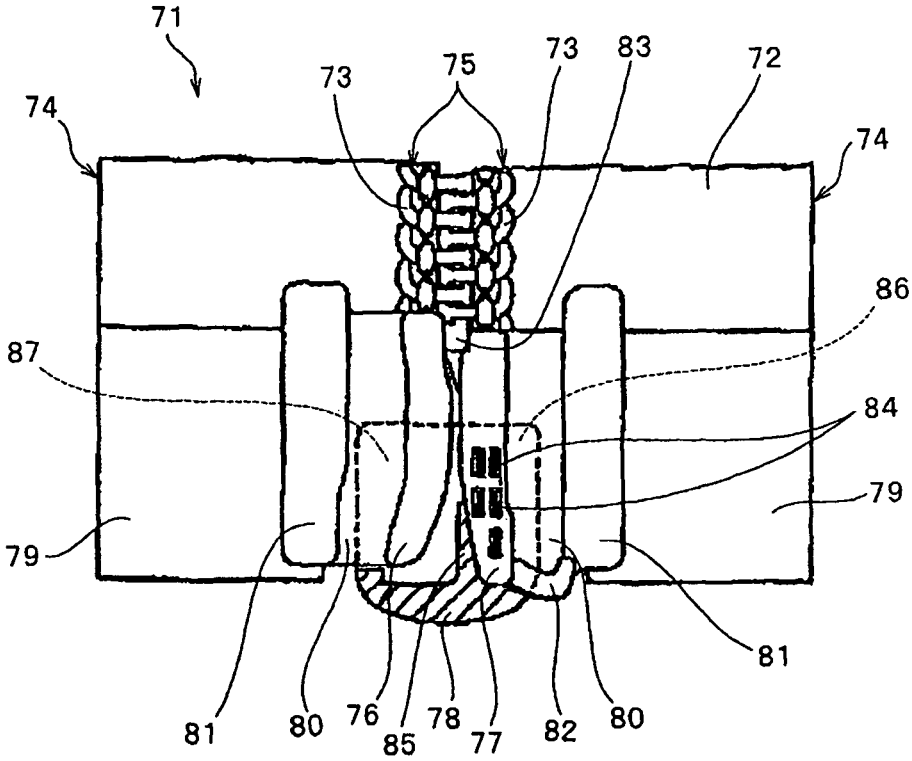
FIG. 15 is a main cross-sectional view illustrating main components of a conventional slide fastener.
Figure 16:
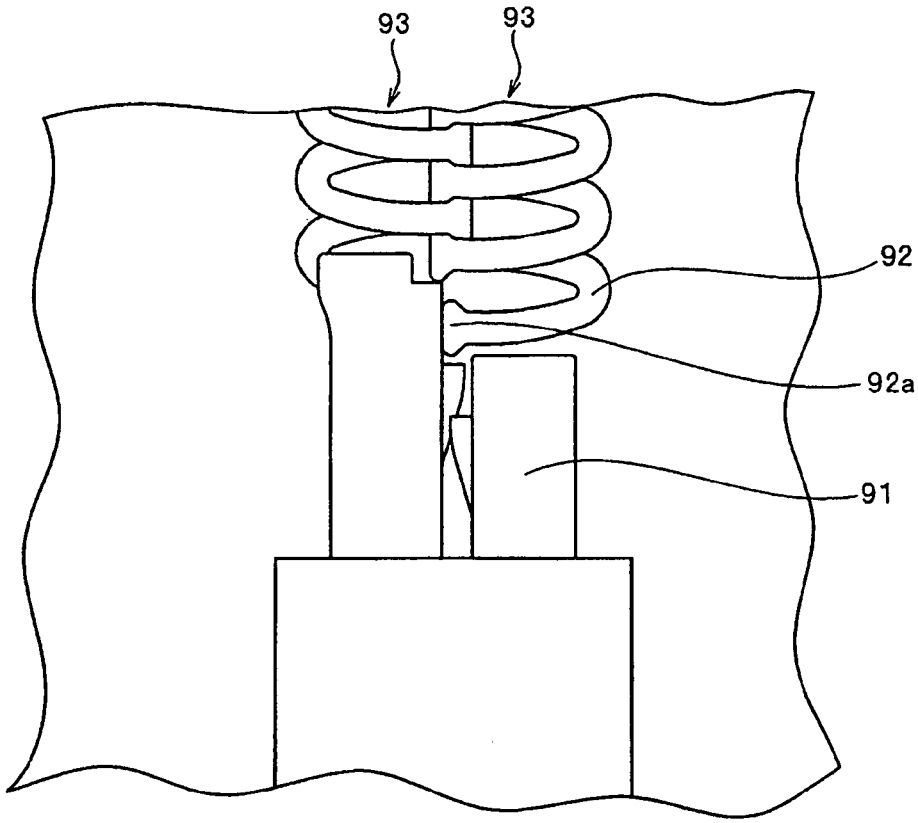
FIG. 16 is an enlarged main view illustrating a state where left and right fastener elements are erroneously coupled with each other in the conventional slide fastener.
Figure 17:
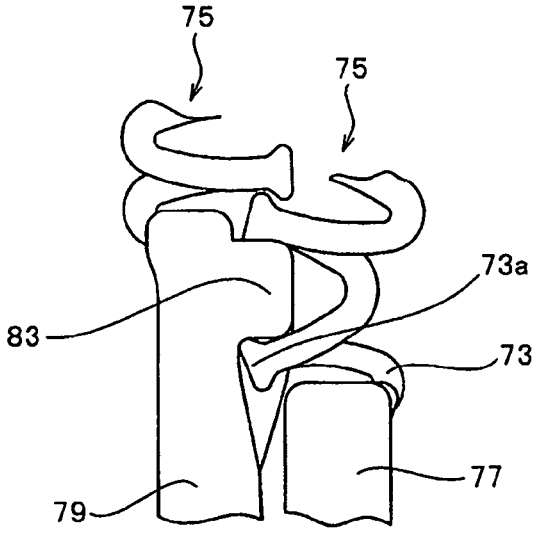
FIG. 17 is an enlarged main view illustrating another state where the left and right fasteners are erroneously coupled with each other in the conventional slide fastener.

Herein, FIG. 11 is a main cross-sectional view illustrating main components of a slide fastener according to a third embodiment; FIG. 12 is a main perspective view illustrating enlargement of a separable pin of the slide fastener; and FIG. 13 is a main perspective view illustrating enlargement of a box pin of the slide fastener. In addition, FIG. 14 is a view for explaining a relationship between the separable pin of the slide fastener and a'locking pawl of a slider.

A slide fastener 50 according to the third embodiment is formed so that the left and right are reversed in the relationship between the separable pin 51 and the box pin 52 in comparison with the aforementioned slide fastener 10 according to the first embodiment. Therefore, the slide fastener 50 is a slide fastener where the separable pin 51 can be inserted from the right-side shoulder opening 29 of the first slider 21*a* into the element guide lane of the second slider 21*b*. In addition, in the third embodiment, parts and elements having the same configurations as those described in the first embodiment are denoted by the same reference numerals, and thus, the description thereof is omitted.

The slide fastener 50 according to the third embodiment includes fastener stringers 11 where element rows 13 are provided to facing side edge portions of a pair of left and right fastener tapes 12, reinforcing portions 14 which reinforce lower end portions of the fastener tapes 12, a first slider (upper slider) 21*a* for upper-opening and a second slider (lower slider) 21*b* for reverse-opening which are allowed to pass through the left and right element rows 13, a synthetic resin separable pin 51 which is attached to a lower end portion of the right-side fastener stringer 11, a synthetic resin box pin 52 which is attached to a lower end portion of the left-side fastener stringer 11, and top stoppers (not shown) 33 which are attached to upper ends of the left and right element rows 13.

Similarly to the aforementioned first embodiment, conventional sliders having a locking pawl 30 which are generally known may be used for the first and second sliders 21*a* and 21*b*.

The separable pin 51 is integrally fixed so as to be continuous with the lower end of the right-side element row 13. The separable pin 51 includes a separable pin body 51*a* having a substantial rectangular column shape, a projecting portion 51*b* which is projected toward the box pin 52 in an end portion area of the separable pin body 51*a* on the side of the element row 13, an insert concave portion 51*c* which is formed in a concave shape in the projecting portion 51*b* and which the later-described protrusion 52*c* of the box pin 52 can be inserted into, a first notch portion 51*d* which is formed on the upper surface side of the projecting portion 51*b*, and an insert piece 51*e* which protrudes upwards from the front end portion of the projecting portion 51*b*.

The box pin 52 is integrally fixed so as to be continuous with the lower end of the left-side element row 13. The box pin 52 includes a box pin body 52*a*, a hook-shaped stopper 52*b* which formed in a lower end portion of the box pin body 52*a*, a protrusion 52*c* having a trapezoidal shape as seen from the top plane, which is disposed to protrude toward the separable pin 51 from the side surface of the box pin body 52*a* facing the separable pin 51, and a second notch portion 52*d* which is formed on the upper surface side of the box pin body 52*a* and which a locking pawl 30 of the second slider 21*b* can be engaged with.

In addition, in the slide fastener 50 according to the third embodiment, the interval A between the inner surfaces of the left and right flange portions 24 in the rear opening side end portion of the first slider 21*a*, the maximum value B of the dimension of the separable pin 51 in the tape width direction, the dimension C of the portion of the box pin 52 in the tape width direction corresponding to the portion of the separable pin 51 having the maximum value B, the element width D of the element rows 13, the dimension E of the area in the tape length direction where the dimension of the separable pin 51 in the tape width direction is larger than the difference between the interval A and the element width D (interval A−element width D), and the size H of (length F of 3 pitches of elements)−(dimension of coupling head 15*a* of fastener element 15 in tape length direction)×3 are set to be the same as those of the aforementioned first embodiment.

Herein, it is preferable that the length from the end portion of the projecting portion 51*b* on the side of the element row 13 to the first notch portion 51*d* is set to be equal to the aforementioned dimension E in the tape length direction or to be longer than the dimension E.

In the slide fastener 50 having the aforementioned configurations according to the third embodiment, it is possible to obtain the same functions and effects as those of the aforementioned first embodiment.

In other words, in the case where the left and right element rows 13 of the slide fastener 50 are coupled with each other, first, the first and second sliders 21*a* and 21*b* that are allowed to pass through the left-side element row 13 are slid down to the lower end position where the second slider 21*b* contacts with the stopper 52*b* of the box pin 52. Subsequently, the separable pin 51 is inserted from the right-side shoulder opening 29 of the first slider 21*a*, and the separable pin 51 is completely inserted into the element guide lane of the second slider 21*b* through the element guide lane of the first slider 21*a*.

At this time, when the separable pin 51 is inserted from the right-side shoulder opening 29 of the first slider 21*a* into the element guide lane of the second slider 21*b*, although the projecting portion 51*b* of the separable pin 51 and the locking pawl 30 of the first slider 21*a* contact with each other (refer to FIG. 11), the locking pawl 30 of the first slider 21*a* is introduced into the first notch portion 51*d* which is formed in the projecting portion 51*b* of the separable pin 51 as illustrated in FIG. 14. After that, if the locking pawl 30 contacts with the upper surface portion of the projecting portion 51*b* of the separable pin 51, the locking pawl 30 is lifted up by the projecting portion 51*b*, so that the locking pawl 30 is recessed from the element guide lane (refer the virtual line of FIG. 14). Therefore, the insertion of the separable pin 51 is not prevented by the locking pawl 30 of the first slider 21*a*.

Therefore, the separable pin 51 is completely inserted from the right-side shoulder opening 29 of the first slider 21*a* into the element guide lane of the second slider 21*b*, so that the separable pin 51 is retained in the state where the separable pin 51 is approximately parallel to the box pin 52. After that, the first slider 21*a* is slid in the upward direction, that is, in the element coupling direction, so that the left and right element rows 13 are stabilized and coupled with each other.

On the other hand, in the case where, when the left and right element rows 13 are coupled with each other, the separable pin 51 is not completely inserted into the element guide lane of the second slider 21*b* and the first slider 21*a* is slid in the element coupling direction in the state where the separable pin 51 is insufficiently inserted, the projecting portion 51*b* of the separable pin 51 and the left-side element row 13 contact with each other to interfere with each other, and the side surface of the separable pin 51 on the side of the fastener tape 12 contacts with the right-side flange portion 24 of the slider.

As a result, the separable pin 51 is retained in the slanted state with respect to the box pin 52, so that it is possible to prevent the separable pin 51 from passing through an inner portion of the slider. In addition, it is possible to prevent the projecting portion 51*b* of the separable pin 51 from being erroneously coupled with the left-side element row 13. Accordingly, since the separable pin 51 together with the slider moves upwards in the state where the separable pin 51 is inserted into the slider, the left and right element rows 13 can be intentionally allowed not to be coupled with each other. Therefore, it is possible to securely prevent the decrease in the coupling strength caused by the erroneous coupling of the left and right element rows 13 or the weakness against a thrust force.

The invention claimed is:

1. A slide fastener comprising:

fastener stringers where continuous-shaped fastener elements are attached to opposing side edge portions of a pair of first and second fastener tapes;

at least one slider which is allowed to pass through first and second element rows constructed with the fastener elements;

a separable pin which is attached to one end portion of the first element row; and a box pin which is attached to the second element row, wherein in the slider, an upper blade and a lower blade are connected to front end portions of shoulder opening sides by a guide post, flange portions are disposed in left and right side edges of the upper blade and/or the lower blade, and rear openings are provided to rear end portions of the upper and lower blades, wherein the separable pin has a projecting portion which is projected toward the box pin when the separable pin is inserted into the box pin, wherein the projecting portion is formed on an area of the separable pin near the one end portion of the first element row and has an insert piece which is projected in a tape length direction from an edge side of the projecting portion towards the first element row, wherein the edge side of the projecting portion faces the box pin when the separable pin is inserted into the box pin, wherein A is a dimension between inner surfaces of the flange portions in a rear end portion of the slider, B is a width dimension of the separable pin from an inner edge to the edge side of the projecting portion, C is a width dimension of an upper side surface of the box pin at a point of the box pin that corresponds to dimension B when the separable pin is inserted into the box pin, D is a width dimension of the fastener elements of the first or the second element row, and dimensions A, B, C and D satisfy a relationship of "C<(A−B)<D", wherein dimension B is set to be smaller than dimension D, and wherein within the area of the separable pin E is a dimension in a tape length direction where a dimension of the separable pin in a tape width direction is larger than (A−D), and the dimension E and dimensions of the element rows satisfy a relationship of "E>(length of one pitch of the fastener elements of the element rows)×3−(a maximum dimension of a coupling head of one of the fastener elements in the tape length direction)×3".

2. The slide fastener according to claim 1, wherein there are two sliders and the two sliders are allowed to pass through the element rows in a direction so that the rear openings are allowed to face each other, and a stopper for stopping the sliders is disposed at an end portion of the box pin opposite to the side of the element rows.

3. The slide fastener according to claim 1, wherein the at least one slider is allowed to pass through the element rows, and a box which the separable pin can be inserted into is disposed at the end portion of the box pin opposite to the side of one of the element rows.

4. The slide fastener according to claim 1, wherein the box pin has a protrusion which protrudes toward the projecting portion of the separable pin when the separable pin is inserted into the box pin, the projecting portion has an insert concave portion which the protrusion can be inserted into, and an end portion of the protrusion on a side of the second element row is located within a range of the dimension E of the separable pin in a state where the protrusion is inserted into the insert concave portion.

5. The slide fastener according to claim 1, wherein a dimension of a portion of the box pin in the tape width direction which is on a lower end side compared to the position facing the projecting portion of the separable pin is set to be larger than the dimension C.

* * * * *

UNITED STATES PATENT AND TRADEMARK OFFICE

CERTIFICATE OF CORRECTION

PATENT NO. : 9,084,454 B2
APPLICATION NO. : 13/060020
DATED : July 21, 2015
INVENTOR(S) : Suguru Ogura It is certified that error appears in the above-identified patent and that said Letters Patent is hereby corrected as shown below:

On the title page item (57), in column 2, in "Abstract", line 1, delete "fasteners," and insert -- fasteners --, therefor.

In the specification,

In column 15, line 67, delete "a'locking" and insert -- a locking --, therefor.

Signed and Sealed this
Twenty-second Day of March, 2016

Michelle K. Lee

Michelle K. Lee
*Director of the United States Patent and Trademark Office*